US006470813B2

(12) United States Patent
Ebata et al.

(10) Patent No.: US 6,470,813 B2
(45) Date of Patent: Oct. 29, 2002

(54) EMBROIDERY SEWING MACHINE

(75) Inventors: Yoshikazu Ebata; Masashi Ninomiya; Eiji Murakami, all of Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 09/855,887

(22) Filed: May 15, 2001

(65) Prior Publication Data

US 2001/0050036 A1 Dec. 13, 2001

(30) Foreign Application Priority Data

May 26, 2000 (JP) ..... 2000-155729

(51) Int. Cl.[7] ..... D05B 19/12; D05B 21/00; D05C 7/00

(52) U.S. Cl. ..... 112/102.5; 112/277

(58) Field of Search ..... 112/102.5, 470.06, 112/470.01, 475.19, 277, 220, 221, 470.04

(56) References Cited

U.S. PATENT DOCUMENTS 4,763,586 A * 8/1988 Takenoya et al. ..... 112/103
5,372,078 A * 12/1994 Hoshina et al. ..... 112/470.04
5,762,011 A * 6/1998 Murakami ..... 112/102.5
5,826,526 A * 10/1998 Tomita ..... 112/102.5
6,167,824 B1 * 1/2001 Tomita ..... 112/102.5

* cited by examiner

*Primary Examiner*—Peter Nerbun
(74) *Attorney, Agent, or Firm*—Nields & Lemack

(57) ABSTRACT

An embroidery sewing machine is disclosed, the sewing machine having a stitch forming device including a needle (71) vertically reciprocated to form stitches on a work to be stitched, an embroidering frame (21) for holding the work and being moved relative to the needle in synchronism with the needle, and the stitch forming device being operated to decide a maximum speed of the vertically reciprocating needle (71) in dependence upon the type and weight of the work and the size and weight of the embroidering frame (21) and being further operated to reduce the speed of the vertically reciprocating needle (71) as the weight of the work and embroidering frame (21) increases and as the embroidering frame (21)is partly moved away from the body of sewing machine in the Y-direction.

11 Claims, 6 Drawing Sheets

| | Stitch data | | | Stitching speed |
|---|---|---|---|---|
| | △X | △y | | |
| 0 | Initial value | Initial value | (Speed) | N = 3 |
| 1 | 2 | 2 | 500 | 300 |
| 2 | 3 | 2 | 400 | 200 |
| 3 | 4 | 2 | 300 | 200 |
| 4 | 5 | 2.5 | 200 | 200 |
| 5 | 3 | 2 | 400 | 400 |
| 6 | 3 | 2 | 400 | 400 |
| 7 | 2 | 2 | 500 | 100 |
| 8 | 2 | 2 | 500 | 100 |
| 9 | 6 | 2 | 100 | 100 |
| 10 | 4 | 2.5 | 300 | 300 |
| 11 | 2 | 2 | 500 | 400 |
| 12 | 3 | 2 | 400 | 400 |
| 13 | 2 | 2 | 500 | 200 |
| 14 | 3 | 2 | 400 | 200 |
| 15 | 5 | 2.5 | 200 | 200 |
| 16 | 5 | 2 | 200 | 200 |
| 17 | 2 | 2 | 500 | 500 |
| 18 | 2 | 2 | 500 | 500 |
| 19 | 2 | 2 | 500 | 300 |
| 20 | 1 | 2 | 500 | 300 |
| 21 | 4 | 2 | 300 | 300 |
| 22 | 2 | 2 | 500 | 200 |
| 23 | 3 | 3 | 400 | 200 |
| 24 | 5 | 2 | 200 | 200 |
| 25 | 2 | 2 | 500 | 500 |
| 26 | 1 | 2 | 500 | 500 |
| 27 | 1 | 2 | 500 | 400 |
| 28 | 2 | 2 | 500 | 300 |
| 29 | 3 | 2 | 400 | 100 |
| 30 | 4 | 2 | 300 | 100 |

| Moving distance of embroidering frame | Speed (rpm) |
|---|---|
| 1 | 500 |
| 1.5 | 500 |
| 2 | 500 |
| 2.5 | 450 |
| 3 | 400 |
| 3.5 | 350 |
| 4 | 300 |
| 4.5 | 250 |
| 5 | 200 |
| 5.5 | 150 |
| 6 | 100 |
| 6.5 | 100 |
| 7 — | Minimum speed |

FIG.4

EMBROIDERY SEWING MACHINE

BACKGROUND OF THE INVENTION AND RELATED ART STATEMENT

FIELD OF THE INVENTION

The present invention relates to an embroidery sewing machine and more particularly relates to a stitching speed control of the sewing machine during embroidery stitching operations It is generally known that the embroidery sewing machine has an embroidering frame provided thereto, the embroidering frame having a work held thereon to be embroidered and being moved in the X-Y direction relative to a vertically reciprocating needle in synchronism with the reciprocating movement of the needle.

In this connection, it is required that the embroidering frame is moved from one to another position while the needle is moved up so as to have stitches formed on the work held by the embroidering frame. The vertical reciprocating speed of the needle (stitching speed) is, therefore, normally decided to meet a maximum distance that is traversed by the embroidering frame while the needle is in the upper position so that the embroidering frame may be safely moved a long distance between two positions.

Such a set speed of the vertically reciprocating needle is constant regardless of the distances short and long that are traversed by the embroidering frame. Therefore, it takes a long time to stitch up one complete pattern. Various devices have been proposed to increase the vertical moving speed of the needle in case the distance that is traversed by the embroidering frame is short. One of the devices is disclosed, for example, in U.S. Pat. No. 5,764,031. Such prior art is, however, designed to give consideration only to the distances to be traversed by the embroidering frame and fails to give consideration to other problems to be solved.

OBJECTS OF THE INVENTION

The invention has been provided to eliminate the defects and disadvantages of the prior art. It is, therefore, a primary object of the invention to control a stitching speed in consideration of the size and weight of an embroidering frame and a work held by the embroidering frame as well as in consideration of the distance to be traversed by the embroidering frame.

It is another object of the invention to control the stitching speed in dependence upon a position of the embroidering frame during stitching operation.

It is another object of the invention to reduce the moving speed of the embroidering frame in case the same is comparatively heavy so as to reduce a load to an X-Y moving mechanism.

It is another object of the invention to reduce the moving speed of the embroidering frame in case the same carries a thick and/or heavy work to be stitched.

It is still another object of the invention to reduce the moving speed of the embroidering frame as the embroidering frame is partly moved away from the body of sewing machine so as to maintain a stabilized stitching operation without vibrations.

SUMMARY OF THE INVENTION

In short, the embroidery sewing machine comprises a stitch forming device including a needle vertically reciprocated to form stitches on a work to be stitched, a moving member including a member for holding the work and being moved relative to the needle in synchronism with the needle, a memory for storing stitch data therein for deciding the positions to which the moving member is moved in accordance with a shape of a pattern to be embroidered, means for giving information regarding the moving member, means for detecting the position of the work, means for controlling the speed of stitching operation of the stitch forming device by use of the information regarding the moving member and the position of the work as parameters, the information regarding the moving member including data of at least one of the thickness, weight and material of the work and data of at least one of the size and weight of the work holding member, the speed control means controlling the stitching speed of the stitch forming device by limiting a maximum speed of the stitch forming device, or by successively calculating out the stitching speed of the stitch forming device, and further by reducing the stitching speed of the stitch forming device as the weight of embroidering frame increases, as the thickness of the work increases and as the moving member is partly moved away from the body of the sewing machine. The embroidery sewing machine further may comprise means for entering the information regarding the moving member and means for detecting the information regarding the moving member.

BRIEF DESCRIPTION OF THE DRAWINGS

FIG. 4 is a table showing a relation between the moving distance and speed of an embroidering frame.

DETAILED DESCRIPTION OF PREFERRED EMBODIMENTS

Figure 1:
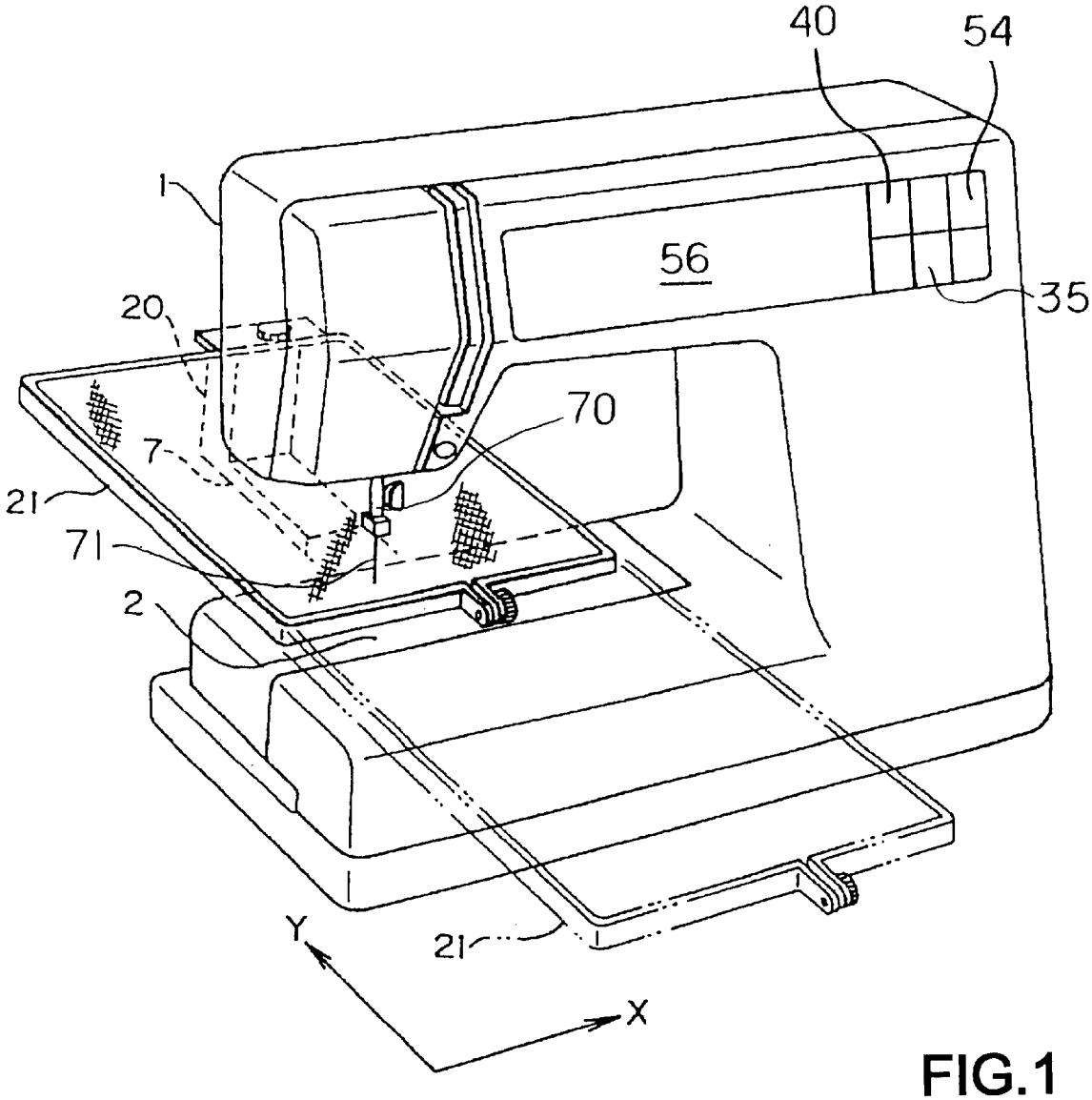
FIG. 1 is a perspective view of an embroidery sewing machine according to the invention.

The invention will be described in reference to the preferred embodiments as shown in the attached drawings. As shown in FIG. 1, the sewing machine of the invention is provided with an arm frame 1 and a base 2. In the base 2, there is provided a carriage 7 which is connected to an X-Y moving mechanism 67 to be moved thereby as will be described in detail hereinlater. The carriage 7 has a distal end constituting an embroidering frame mounting part 20 as extended out of the base 2 to allow an embroidering frame 21 to be mounted to thereto. In the arm frame 1, there is provided a needle bar 70 having a needle 71 attached to the lower bend hereof constituting a part of a stitch forming mechanism 62 which will be described in detail hereinlater.

The embroidering frame 21 has a cloth extended thereon to be embroidered and constitutes a moving member which is moved as the carriage 7 moves in the X-Y direction relative to the vertically reciprocating needle 71 such that the embroidery stitches may be formed on the cloth while the needle 71 is vertically moved. The embroidery stitching operation may be selected by operating a mode selecting button 54 as will be described in detail hereinlater. In case the embroidery stitching operation is not carried out, the ordinary stitching operation may be carried out, wherein a cloth feeding device (not shown) is operated to transport the cloth relative to the needle 71.

Figure 2:
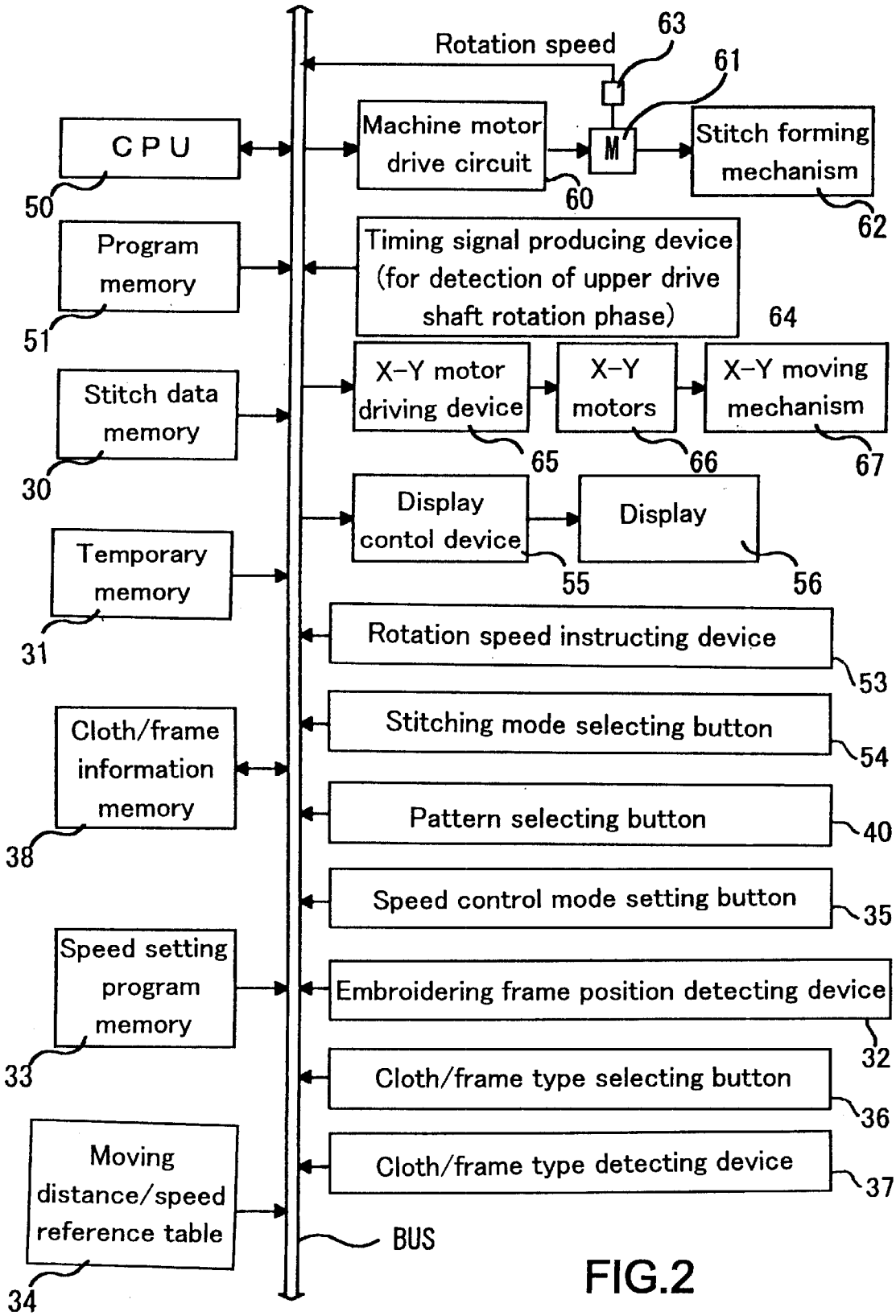
FIG. 2 is a block diagram showing the essential elements of the invention.

FIG. 2 shows a hardware including the devices of the invention as indicated in blocks. The embodiment will be described in detail in reference to FIG. 1.

The CPU 50 is provided to control the operation of the sewing machine in accordance with the programs stored in a program memory 51. In case of the ordinary stitching operation, the CPU 50 is operated in accordance with the instruction given by a rotation speed instructing device 53 including a foot-operated speed controller or the like to control a machine motor drive circuit 60, thereby to rotate a machine motor 61 at an instructed speed, thus to operate the stitch forming mechanism 62. The embroidery stitching operation may be carried out at a speed decided by a program stored in a speed setting program memory 33 as will be described in detail hereinlater.

The stitch forming mechanism 62 includes the needle bar 70, the needle 71 and the cloth feeding device (not shown), as shown in FIG. 1, to do a predetermined stitching operation. The number of rotations of the machine motor 61 is detected by a motor rotation sensor 63 and fed back to the CPU 50 for controlling the rotation of the machine motor 61.

The embroidering sewing machine is provided with an X-Y motor drive circuit 65, X-Y motors 66 and an X-Y moving mechanism 67 in addition to the machine motor drive circuit 60 which are operated in accordance to the pattern data given from the stitch data memory 30 to do a pattern stitching a operation. As mentioned hereinbefore, the X-Y moving mechanism 67 is provided with the carriage 7 having the embroidering frame mounting part 20 as shown in FIG. 1, the embroidering frame mounting part 20 having the embroidering frame 21 removably mounted thereto with a cloth being held on the embroidering frame 21 such that the cloth may be moved in the X-Y direction relative to the vertically reciprocating needle 71 in synchronism with the reciprocating movement of the same. Thus the embroidery stitching operation may be carried out.

In FIG. 1, Y indicates a depth direction and X indicates a width direction of the body of sewing machine. According to the embodiment, the X-Y moving mechanism 67 is so formed as to telescopically move the distal end 20 of the carriage 7 in the Y-direction beyond the depth length of the bed 2 of the sewing machine.

A timing signal producing device 64 is provided to detect the rotation phase of an upper drive shaft (not shown) which is operatively connected to the needle bar 70 to vertically reciprocate the same, thereby to detect the vertical reciprocating movement of the needle 71 and produces a detection signal. The CPU 50 is operated in response to the detection signal to control the driving operation of the X-Y motor drive circuit 65, thereby to operate the X-Y moving mechanism 67 in time with the stitch forming mechanism 62.

The embroidery stitching operation and the ordinary stitching operation may be switched over by operating the mode selecting button 54 which is provided on a front side of the arm frame 1 of sewing machine as shown in FIG. 1.

Further, the front side has a display 56 provided thereat which is operated under the control of a display control device 55 to make various indications in response to the instructions from the CPU 50.

Further, the reference numeral 31 denotes a temporary memory.

The CPU 50 has further an embroidering frame position detecting device 32, the aforementioned speed setting program memory 33, a moving distance/speed reference table 34 and a speed control mode setting button 35 connected thereto.

According to the embodiment, the embroidering frame position detecting device 32 is provided to successively detect and confirm the positions of the embroidering frame 21 in reference to the initial position thereof and the stitch data stored in the stitch data memory 30. Alternatively, the positions of the embroidering frame 21 may be detected by a position sensor provided directly to the embroidering frame 21, X-Y motors 66, the X-Y moving mechanism 67 or to the carriage 7.

According to the embodiment, the speed control mode setting button 35 is provided to decide a speed control mode and may be selectively operated to decide a mode for limiting a maximum operation speed of the stitch forming mechanism 62 or a mode for calculating out an optimum operation speed of the stitch forming mechanism 62 with respect to one or more stitches in accordance to the stitching condition.

The CPU 50 further has a cloth/frame type selecting button 36, a cloth/frame type detecting device 37 and a cloth/frame type information memory 38 connected thereto.

The cloth/frame type selecting button 36 is manually operated to select a type of cloth to be stitched or a type of embroidering frame to be used. The type of cloth is classified in dependence upon weight, thickness or material. The material is further classified in dependence upon friction resistance. The type of embroidering frame is classified in dependence upon size, weight and so on. The classification may, however, be optional as is occasionally required.

The information concerning the types of cloth and embroidering frame is stored in the cloth/frame type information memory 38 and may be selectively recovered from the memory 38 by operating the cloth/frame type selecting button 36.

One or both of the cloth/frame type detecting device 37 and the cloth/frame type selecting button 36 may be selectively provided. The cloth/frame type detecting device 37 is provided to detect the type of the embroidering frame 21 mounted to the embroidering frame mounting portion 20 of the carriage and the type of the cloth held by the embroidering frame 21 to be embroidered. The cloth/frame type detecting device 37 may include a sensor provided at the embroidering frame mounting portion 20 to detect a frame discrimination signal provided at the embroidering frame 21, and may further include a light sensor for reflecting a light to detect the type of the cloth and a weight sensor for detecting the weight of the cloth.

The type of cloth and/or type of embroidering frame detected by the cloth/frame type detecting device 37 may be utilized to read out the corresponding information from the cloth/frame type information memory 38.

The speed setting program memory 33 is provided to decide the maximum speed limitation of the stitch forming mechanism 62 on the basis of the information recovered from the cloth/frame type information memory 38, namely on the basis of the types of cloth and embroidering frame and the position of the embroidering frame. The maximum speed limitation will not be varied on account of the types of cloth and embroidering frame, but may be reset per stitch or a plurality of stitches in dependence upon the position of the embroidering frame since the position of the embroidering frame is progressively changed during the stitching operation.

In case the types of cloth and embroidering frame and the position of the embroidering frame are used as a plurality of parameters, the maximum speed limitation is sought per parameter and the minimum speed is selected among the parameters to control the operation of the stitch forming mechanism 62.

The speed setting program memory 33 is so designed as to fundamentally decide the stitching speed on the basis of the stitch dada stored in the stitch data memory 30. In case the stitching speed exceeds the maximum speed which is sought from the parameters, the maximum speed that is sought from the parameters is used to control the stitching operation.

The decision of stitching speed by the sped setting program memory 33 is disclosed in U.S. Pat. No. 5,764,031 of the same applicant. The decision is made as follows.

Figure 3:
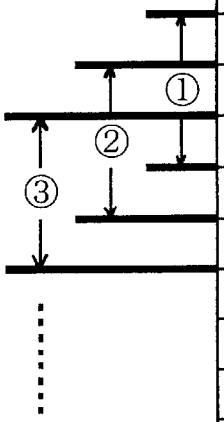
FIG. 3 is an explanatory view of a system of the invention for deciding an operation speed of the sewing machine.

In reference to FIG. 3 showing the stitch data stored in the stitch data memory 30 by way of example, the addresses from 0 to 30 arranged in stitching sequence have the X and Y relative coordinates Δx and Δy given thereto respectively as representing the moving distances of the moving member including the embroidering frame 21 and the cloth.

As shown in FIG. 4, the moving distance/speed reference table 34 has the moving distances of the embroidering frame 21 and the corresponding speeds set as predetermined therein. The moving distance of the embroidering frame 21 may be calculated out from the coordinates Δx and Δy or may be decided as adopting a larger value of the coordinates Δx and Δy.

Each of the addresses has a speed as being set thereto corresponding to the moving distance (relative coordinates). According to the embodiment, the speed is set as provided in the moving distance/speed reference table 34 corresponding to a larger value of the coordinates Δx and Δy. For example, at the address 2, since the moving amount is 3 in the X-direction and the moving amount is 2 in the Y-direction, the speed 400 is set as corresponding to the moving amount 3 as shown in FIG. 4.

Subsequently, the addresses are divided in blocks of a predetermined number N of addresses in sequence with each of the addresses being decided as the first address of each block. For example, in case of N=3 as particularly shown in FIG. 3, the addresses from 1 to 3 form a block $\hat{1}$, and the addresses from 2 to 4 form the next block $\hat{2}$, and the addresses from 3 to 5 form the still next block $\hat{3}$. Further, in each block, a minimum speed Vn is given to the first address as the stitching speed. For example, in block $\hat{1}$, the speeds of the addresses are sequentially 500, 400, 300. Among the speeds, 300 is minimum. It is, therefore, 300 that is the speed of address 1.

The speed thus decided is compared with the maximum speed. In case the former is lower than the latter, the former is employed to drive the stitch forming mechanism 62. In case the former is higher than the latter, the latter is employed to drive the stitch forming mechanism 62.

Alternatively, the stitch forming mechanism 62 may be driven with direct introduction of a driving speed by use of a function on the basis of the information concerning the types of cloth and embroidering frame and the position of the embroidering frame.

Figure 5:
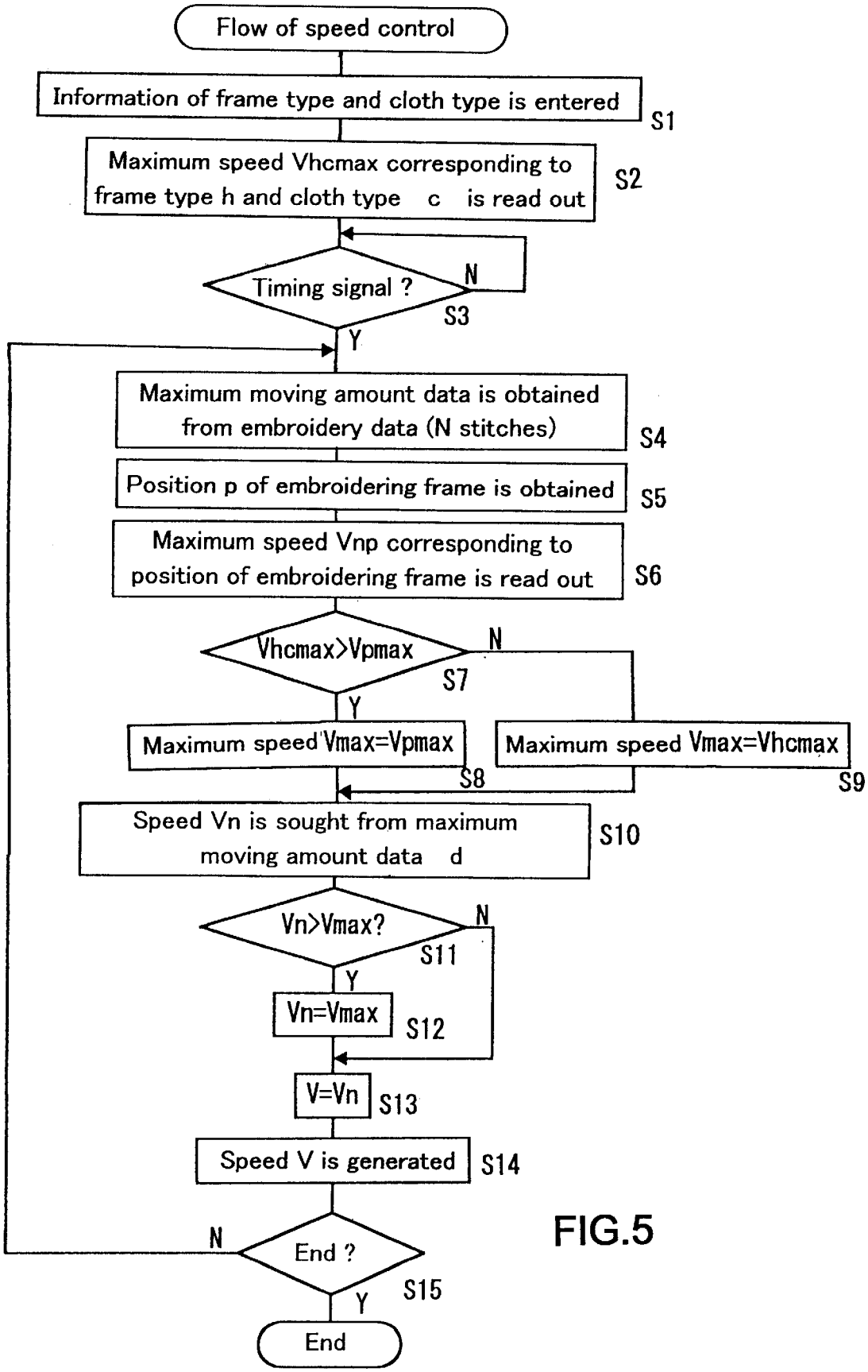
FIG. 5 is a flow chart showing the operation of the invention.

The operation for setting the upper maximum speed will be described in reference to FIG. 5.

At first, the information regarding the type h of embroidering frame and the type c of cloth is entered by operating the cloth/frame type selecting button 36 (Step 1). The CPU 50 is operated in response to the entered information to set a maximum speed Vhcmax (Step 2).

With the timing signal being given from the timing signal producing device 64 (Step 3), the CPU 50 is operated to obtain a maximum moving amount data d from the embroidery data (Step 4) and simultaneously obtain a position p of the embroidering frame from the frame position detecting device 32 (Step 5). Further, the CPU 50 is operated to read out a maximum speed Vpmax corresponding to the frame position p (Step 6) and compare the upper maximum speed Vhcmax and the maximum speed Vpmax (Step 7) and decide a lower one as the maximum speed Vmax (Steps 8 and 9).

Subsequently, the CPU 50 is operated to seek the speed Vn of the stitch forming mechanism 62 from the obtained maximum moving amount data d in accordance with the algorithm as mentioned above (Step 10), and to decide if the speed Vn is higher than the maximum speed Vmax or not (Step 11). In case the speed Vn is higher than the maximum speed Vmax, the maximum speed Vmax is employed (Step 12) and if not, the speed Vn is employed (Step 23). Thus the CPU 50 gives the instruction to generate the decided speed (Step 14) and terminates the operation (Step 15).

Figure 6:
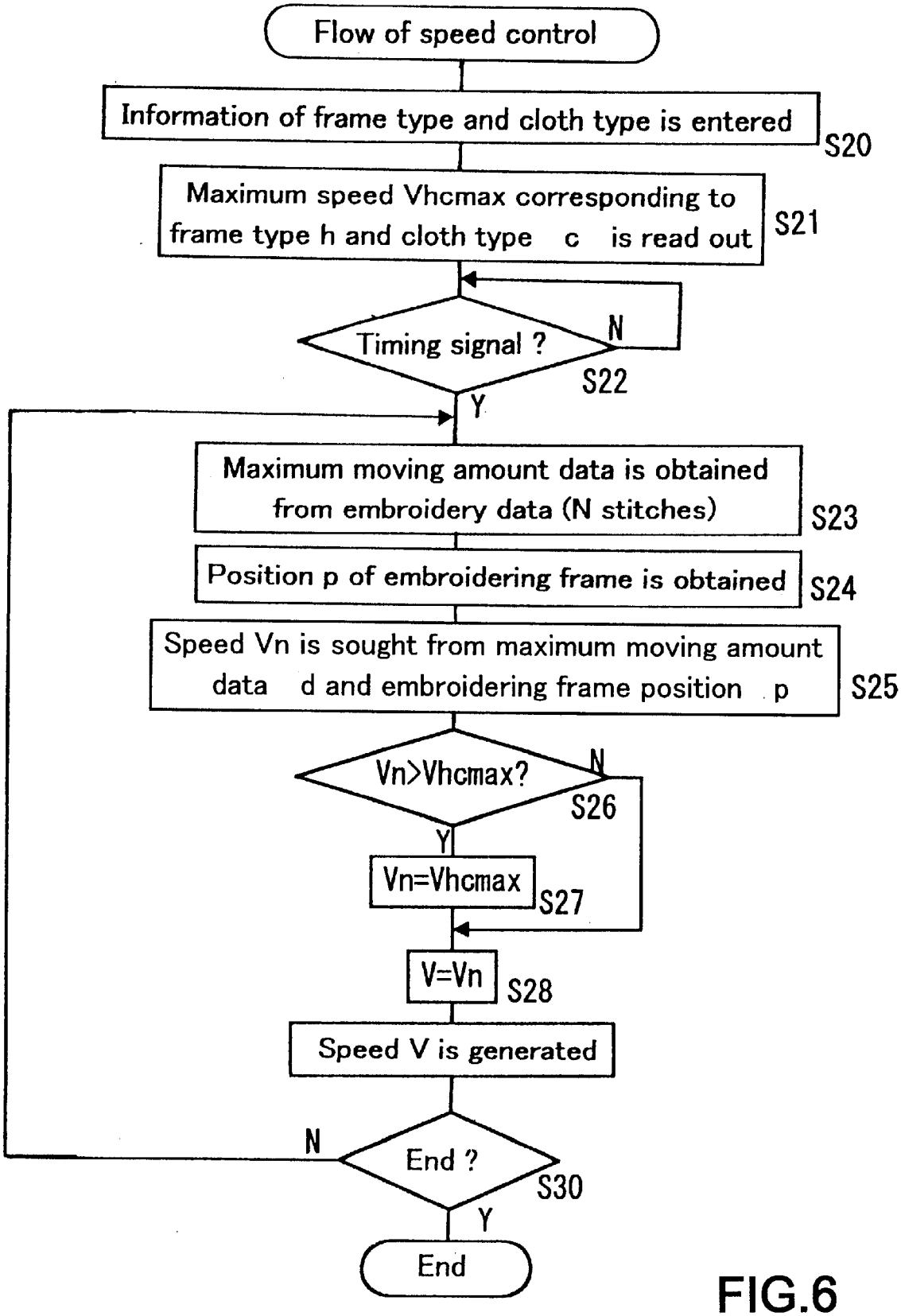
FIG. 6 is a flow chart showing another embodiment of operation of the invention.

The operation for directly and successively seeking the speed of the stitch forming mechanism 62 will be described in reference to FIG. 6.

At first, the information regarding the type h of embroidering frame and the type c of cloth is entered by operating the cloth/frame type selecting button 36 (Step 20). The CPU 50 is operated in response to the entered information to set a maximum speed Vhcmax (Step 21).

With the timing signal being given from the timing signal producing device 64 (Step 22), the CPU 50 is operated to obtain a maximum moving amount data d from the embroidery data (Step 23) and simultaneously obtain a position p of the embroidering frame from the frame position detecting device 32 (Step 24).

Subsequently, the CPU 50 is operated to seek on the basis of a predetermined function the speed Vn of the stitch forming mechanism 62 from the obtained maximum moving amount data d and the embroidering frame position p (Step 25), and to decide if the speed Vn is higher than the maximum speed Vmax or not (Step 26). In case the speed Vn is higher than the maximum speed Vmax, the maximum speed Vmax is employed (Step 27) and if not, the speed Vn is employed (Step 28). Thus the CPU 50 gives the instruction to generate the decided speed (Step 29) and terminates the operation (Step 30).

According to the embodiment, only the positions of the embroidering frame 21 in the Y-direction are used as parameters. However, depending upon the structure of the X-Y moving mechanism 67, the positions of the embroidering frame 21 in the X-direction may be used as parameters in addition to the parameters in the Y-direction so as to obtain stabilized stitching operation.

According to the invention as described hereinbefore, the speed control of stitching operation may be carried out in accordance with the type of cloth to be stitched, the type of embroidering frame holding the cloth and the positions of the embroidering frame during stitching operation such that the embroidery sewing machine may be driven in a stabilized condition and, therefore, the embroidery stitching operation may be carried out in a stabilized condition.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An embroidery sewing machine having a stitch forming device including a needle vertically reciprocated to form stitches on a work to be stitched, a moving member including a member for holding the work and being moved relative to the needle in synchronism with the needle, a memory for storing stitch data therein for deciding the positions to which the moving member is moved in accordance with a shape of a pattern to be embroidered, said embroidery sewing machine comprising:

a) means for providing information regarding said moving member, b) means for controlling the speed of stitching operation of said stitch forming device by use of said information regarding said moving member as a parameter, wherein said speed control means controls the stitching speed of said stitch forming device by reducing the stitching speed of said stitch forming device as said moving member is partly moved away from the body of said sewing machine.

2. An embroidery sewing machine having a stitch forming device including a needle vertically reciprocated to form stitches on a work to be stitched, a moving member including a member for holding the work and being moved relative to the needle in synchronism with the needle, a memory for storing stitch data therein for deciding the positions to which the moving member is moved in accordance with a shape of a pattern to be embroidered, said embroidery sewing machine comprising;

a) means for giving information regarding said moving member, b) means for detecting the position of said work, c) means for controlling the speed of stitching operation of said stitch forming device by use of said information regarding said moving member and the position of said work as parameters.

3. The embroidery sewing machine as defined in claim 2, wherein said work includes a cloth, and wherein said information regarding said moving member includes data of at least one of the thickness, weight and material of said cloth.

4. The embroidery sewing machine as defined in claim 2, wherein said information regarding said moving member includes data of at least one of the size and weight of said work holding member.

5. The embroidery sewing machine as defined in claim 2, wherein said speed control means controls the stitching speed of said stitch forming device by limiting a maximum speed of said stitch forming device.

6. The embroidery sewing machine as defined in claim 2, wherein said speed control means controls the stitching speed of said stitch forming device by successively calculating out the stitching speed of said stitch forming device.

7. The embroidery sewing machine as defined in claim 2, further comprising means for entering said information regarding said moving member.

8. The embroidery sewing machine as defined in claim 2, further comprising means for detecting said information regarding said moving member.

9. The embroidery sewing machine as defined in claim 2, wherein said speed control means controls the stitching speed of said stitch forming device by reducing the stitching speed of said stitch forming device as the weight of said moving member increases.

10. The embroidery sewing machine as defined in claim 2, wherein said speed control means controls the stitching speed of said stitch forming device by reducing the stitching speed of said stitch forming device as the thickness of said work increases.

11. The embroidery sewing machine as defined in claim 2, wherein said speed control means controls the stitching speed of said stitch forming device by reducing the stitching speed of said stitch forming device as said moving member is partly moved away from the of body of said sewing machine.

* * * * *